United States Patent [19]

Biasiotto et al.

[11] Patent Number: 5,025,576

[45] Date of Patent: Jun. 25, 1991

[54] SOLE FOR SPORTS SHOES

[75] Inventors: Vittorio Biasiotto; Leonildo Masiero, both of Vicenza, Italy

[73] Assignee: Biasiotto Contrafforti Di Biasiotto Vittorio & C.s.a.s., Vicenza, Italy

[21] Appl. No.: 387,015

[22] Filed: Jul. 27, 1989

[30] Foreign Application Priority Data

Jan. 10, 1989 [IT] Italy ..... 85502 A/89
Feb. 2, 1989 [IT] Italy ..... 85515 A/89

[51] Int. Cl.[5] ..... A43B 5/00; A43C 15/00
[52] U.S. Cl. ..... 36/134; 36/67 D
[58] Field of Search ..... 36/67 D, 67 A, 67 R, 36/134, 127, 128

[56] References Cited

U.S. PATENT DOCUMENTS

| | | | |
|---|---|---|---|
| 2,192,150 | 2/1940 | Pierce et al. | 36/134 |
| 2,207,476 | 7/1940 | Bernstein | 36/67 D |
| 3,195,246 | 7/1965 | Ueda | 36/67 D |
| 4,299,038 | 11/1981 | Epple | 36/67 D |
| 4,445,288 | 5/1984 | Fror | 36/67 A |
| 4,492,047 | 1/1985 | Arff | 36/134 |
| 4,706,394 | 11/1987 | Regula | 36/134 |
| 4,791,692 | 12/1988 | Collins | 36/67 A |

FOREIGN PATENT DOCUMENTS

| | | | |
|---|---|---|---|
| 92119 | 4/1938 | Sweden | 36/67 D |
| 401185 | 11/1933 | United Kingdom | 36/67 D |
| 2191677 | 12/1987 | United Kingdom | 36/134 |

*Primary Examiner*—Steven N. Meyers
*Attorney, Agent, or Firm*—Bucknam and Archer

[57] ABSTRACT

The invention describes a sole 1 for sports shoes, and particularly suitable for football, of the type which presents in the sole itself a plurality of recesses for fixing in a reversible fashion an accessory element such as a cleat or a heel. An essential feature of the invention consists of the fact that the element is not screwed as it is conventional to another structure integral with the recesses for fixing the accessory element to the sole, but is screwed to a tongue 6 which is inserted in a slit 4 formed in the recesses for fixing the element to the sole. The tongue 6 remains blocked within the recesses in a position transversal with respect to the slit during the step when the accessory element is being screwed in position.

7 Claims, 2 Drawing Sheets

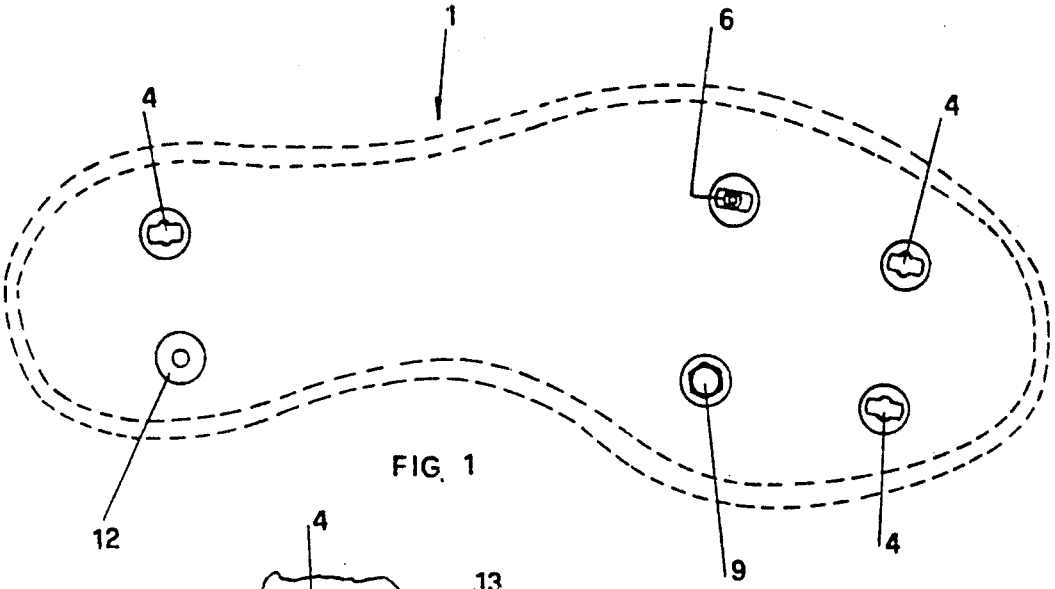
FIG. 1
FIG. 2
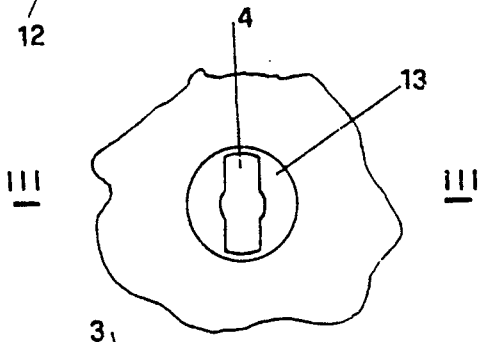
FIG. 3
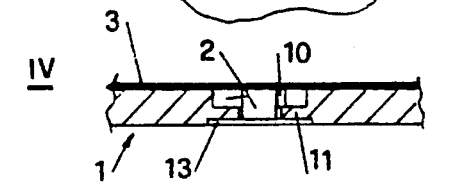
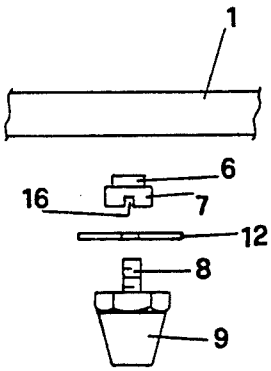
FIG. 7
FIG. 4
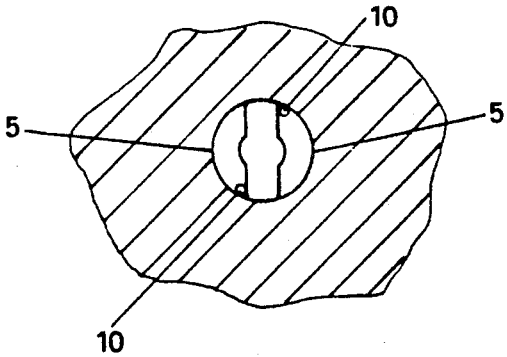
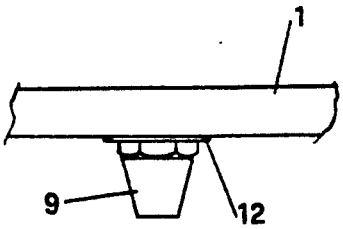
FIG. 8
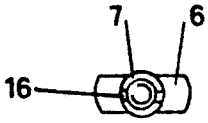
FIG. 5
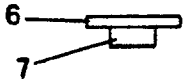
FIG. 6

SOLE FOR SPORTS SHOES

The present invention relates to soles for sports shoes of the type which has some accessories, such as cleats and similar accessories which are reversibly mountable on the soles.

BACKGROUND OF THE INVENTION

It is known that sports shoes, and particularly the shoes which are intended to be used in football, have corresponding to the lower surface of the sole, some elements which project outwardly, commonly called cleats, which serve the purpose of increasing the grip of the shoes onto the ground and facilitating greatly for the athlete the performance of his sport. There are commercially soles of this type which are made of plastic material by press-work in which the cleats are made during the production so that they result integral with the remaining part of the shoes. This method of manufacture is suitable for the production of economical shoes, while in actual practice for the sport for more professional people or for amateurs of a higher level, these shoes at the most are capable of being utilized on hard ground, but are not suitable for use on damp or wet ground. In these situations, there are used shoes with soles which present cleats made of metallic or plastic material, which are provided with a threaded extension corresponding to the surface to be placed on the sole, the extension being capable of engaging with a body provided with an internally threaded bushing which is incorporated in the body of the sole at the time when the shoe is manufactured.

Unfortunately, the threading of the bushing mentioned hereinabove is likely to be damaged substantially so that after they are screwed or unscrewed a few times it is not possible to screw or unscrew the cleat from the position of insertion. The fact that one or both threadings are likely to be damaged causes lack of the necessary adhesion between the bushing and the cleat so that the cleat moves in the seat when the shoe is in use. In this case the defect of even a single bushing is likely to render the entire sole, and obviously the entire shoe, not suitable for use because the cleat cannot be changed, at least without recourse to an expert shoe repair store. The same drawback exists in the case in which the threaded extension of the cleat breaks when it is inserted within its threaded seat.

SUMMARY OF THE INVENTION

An object of the present invention is to provide a sole for sports shoes of the type with cleats and other accessories capable of being releasably mountable due to which it is possible to eliminate the drawbacks mentioned hereinabove so that it is always possible to substitute the accessory easily.

The crux of the present invention resides in providing a sole for shoes of the type which comprises means capable of permitting the releasable fixing of the accessory elements such as cleats and similar elements by screwing in such a manner that these means have the configuration of recesses in the body of the sole to which access is provided through a slit formed in the surface of the sole in which the accessory elements are placed. The recess on the other hand, is closed corresponding to the part which is placed towards the internal part of the sole. A tongue is insertable into the slit, the tongue presenting in particular threaded means with which another corresponding threaded means may be engaged, the latter being formed in the accessory element. The internal walls of the recess located corresponding to the first greater dimension of the slit, have the shape of a circular segment with a diameter corresponding to the greater dimension of the tongue. Further, on the same walls there are provided means for stopping the tongue in a position which is transversal with respect to the greater dimension of the slit.

This structure may be produced directly in the body of the sole by suitably shaping the sole or these structures may be configured as a body to be inserted during the manufacture of the sole in notches formed in the same sole.

With respect to the means being used for the purpose of stopping the rotation of the tongue, they may consist of ribs or protruberances located on the side of the slit. Alternately, the internal walls of the recess may be formed in such a manner to present sections which are transversal with respect to the first greater dimension of the slit.

In actual practice, no matter what the particular embodiment of the invention is, the tongue after it is inserted within the slit, may be caused to rotate around its central axis disposing itself transversally with respect to the longitudinal direction of the slit and remaining blocked within the recess.

When the user completes the screwing of the cleat on the tongue, the latter due to friction rotates in the direction of rotation of the cleat so that the tongue rapidly reaches the transversal position mentioned hereinabove, particularly against the means being used to stop the rotation. At this point the user may easily continue the operation of screwing of the cleat up to completion to obtain the blocking of the cleat.

It is clear that the device of the present invention permits to avoid all the drawbacks present in the known devices. In fact even in the case in which the tongue with its threaded means becomes damaged or breaks, it is possible to replace it, while on the contrary, the means being used to keep the tongue in proper position are not likely to be damaged because they do not present any threading, and they accomplish simply the function of mechanically holding the tongue.

BRIEF DESCRIPTION OF THE DRAWING

These and other features of the present invention will become more clear by reference to particular embodiments which are illustrated herein by way of examples and which are not intended to limit the invention illustrated in the accompanying drawings of which:

FIG. 1 illustrates a bottom view of the sole of the present invention according to a first embodiment in which some cleats are present, but other accessory elements are in the phase of being mounted on the sole.

FIG. 2 is a planar view of one of the means used to block the cleats according to the first embodiment of the invention.

FIG. 3 is a cross-sectional of the means of FIG. 2 according to line III—III of FIG. 2.

FIG. 4 is a cross-sectional view of the internal part of the means of FIGS. 2 and 3, according to line IV—IV in FIG. 3.

FIGS. 5 and 6 represent a planar and a side view respectively of the tongue with the threaded bushing to be inserted within the means of FIG. 2.

FIG. 7 is an exploded side view of the portion of the sole of the present invention according to the first embodiment.

FIG. 8 is a side view of a portion of the sole in which the cleat and other accessories have already been inserted in the blocking means present according to the first embodiment of the invention.

DESCRIPTION OF THE PREFERRED EMBODIMENTS

Figure 9:
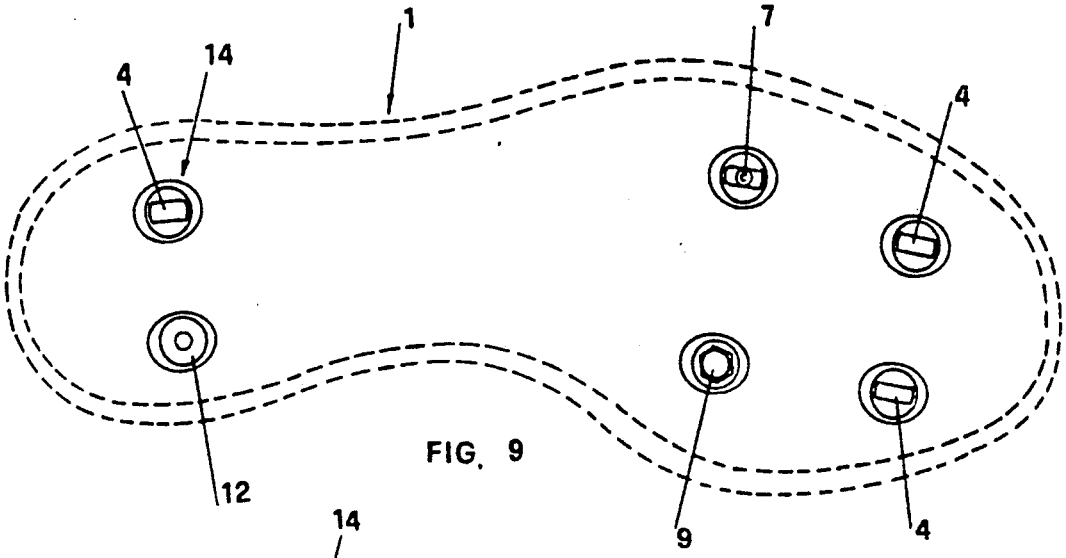
FIG. 9 is a planar bottom view of the sole of the invention according to a second embodiment in which some of the cleats are absent but other elements are present in the mounting phase.
Figure 10:
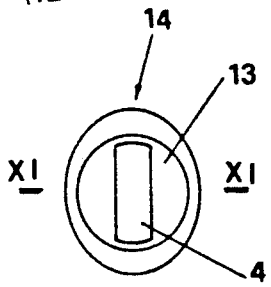
FIG. 10 is a planar view of one of the bodies incorporated within the sole according to the second preferred embodiment of the invention.
Figure 15:
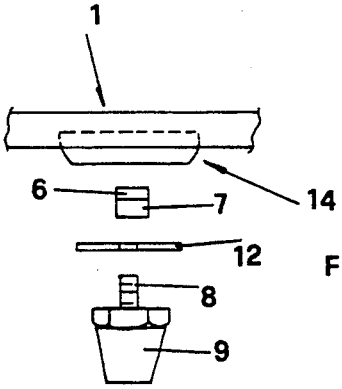
FIG. 15 illustrates a segment of the sole in which is incorporated a body according to the second embodiment of the invention while the other elements to be inserted into the body are represented in exploded form.
Figure 11:
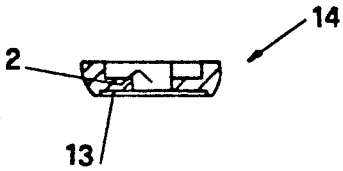
FIG. 11 is a transversal view in cross-section of the body according to FIG. 10 according to the line XI—XI in FIG. 10.
Figure 12:
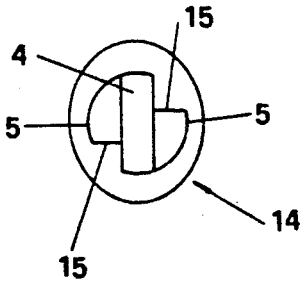
FIG. 12 illustrates the other planar view of the same body.
Figure 16:
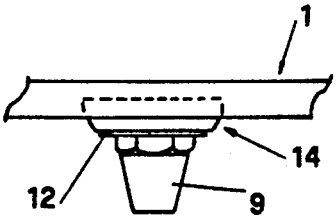
FIG. 16 illustrates a side view of a segment of the sole in which the cleat and the other accessory elements have already been inserted into the body incorporated in the sole.
Figure 13:
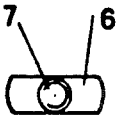
FIGS. 13 and 14 illustrate a planar and a side view respectively of the tongue to be inserted within the body mentioned hereinabove.

In accordance with the invention according to the first embodiment, the sole (1) has in the areas corresponding to each of the areas in which a cleat or similar element has to be attached, a recess (2) which is made within the thickness of the same sole and it is incorporated in the same. The recess is closed corresponding to the part turned towards the interior of the sole by a suitable head or it may be directly closed by the internal part of the sole or as shown in FIG. 3 may be closed by an intersole (3) or similar structure applied to the upper surface of the sole.

The recess communicates towards the exterior by means of a slit (4) which is placed corresponding to the surface of the sole to which the cleats have to be attached. The recess presents internal walls (5) corresponding to the first greatest dimensional of the slit, in the shape of circular segments with a concavity turned towards the same lateral walls. Within the slit a tongue (6) is inserted, the greater dimension of which is equal to the diameter of the circular sectors (5). Further, the tongue after having been inserted in the recess through the slit (4) may be subjected to a rotation motion so as to be in a position transversal with respect to the same slit.

The tongue presents in the central portion a threaded bushing (7) with which the threaded extension (8) of the cleat (9) may be engaged.

This bushing must be arranged in such a manner to be turned towards the slit instead of being turned towards the bottom of the recess so that the insertion of the threaded extension (8) of the cleat (9) may be engaged in the interior.

The tongue, after having been placed within the recess, may be subjected to a rotation motion preliminarily or after the same action up to be brought until it is in position against the stopping means (10) which have the shape of a protruberance or a rib and which are placed on the side of the slit along the circular run of the tongue and which serve the purpose of blocking further motion of the tongue.

After the tongue has been placed in this position, it remains blocked so that the operation of screwing the cleat (9) may be completed. For this purpose it is useful to utilize a washer (12) which may be integral with the cleat, but may be separate from the cleat. The washer is placed around the extension element (8) so as to avoid the possibility that the cleat be displaced sideways when the shoe is being worn. In this case it is necessary to provide a circular seat (13) corresponding to the top (11) of the recess in which the washer must be inserted.

According to another embodiment of the invention, the blocking means for the cleat (9) may consist of a body (14) which must be inserted within suitable cavities formed within the body of the same sole. These bodies (14) have such a shape that in the interior there is formed the recess (2) to which one has access through the slit (4).

Corresponding to the part of the bodies (14) which is placed internally within the sole, a suitable washer is inserted which serves to delimit the recess. Alternatively, the function of the washer may be exerted directly by the body of the sole. Also in this case the lateral walls (5) have the shape of a circular segment: in the case in which one desires to utilize the washer (12), the circular seat (13) may be formed directly on the surface which must be turned towards the exterior of the bodies (14).

Both in the present embodiment as well as in the first embodiment discussed hereinabove, the elements capable of blocking the rotation of the tongue (6) may be constituted by segments (15) of the lateral walls of the recess which are disposed transversally with respect to the greater dimensions of the slit.

Figure 17:
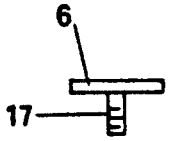
FIGS. 17 and 18 illustrate a modification of the means being used for screwing the elements according to the invention.
Figure 14:
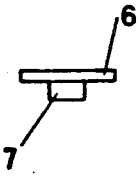
Figure 18:
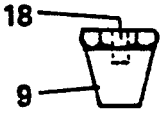

The tongue (6) shown in FIGS. 5 and 6 may further be provided with cut-outs (16) which are disposed diametrically opposite at its extremities so as to permit to the individual wearing the shoes the possibility of causing the tongue to rotate also by means of a screwdriver or similar device for the preliminary positioning with respect to the screwing of the cleat. This also serves the purpose of facilitating the removal from the recess after it has been unscrewed if a substitution of the cleat is required. As shown in FIGS. 17 and 18 in the device according to the present invention, the tongue (6) may present in the location of the bushing a threaded extension (17) which must be inserted within a suitable threaded seat (18) formed within the cleat (9).

What is claimed is:

1. A sole assembly for sports shoes comprising at least one accessory element (9) releasably mountable on said sole, said accessory element (9) having a threaded portion, said sole has at least one cavity, at least one body (14) is inserted within said cavity, one recess (2) is formed in said body, said recess communicating towards the exterior by means of a slit (4) formed in said body, said slit having a first dimension greater than a second dimension, a tongue (6) insertable in said slit, said tongue having a dimension greater than the second dimension, said recess having interior walls (5) corresponding to the first greater dimension of the tongue in the shape of circular segments, the first greater dimension of said tongue being equal to the diameter of said circular segments, said tongue having an internal threaded bushing (7), said threaded portion of the accessory element engaging with said threaded bushing when said tongue is inserted in said slit and when said tongue is rotated to be in a position transversal with respect to the first greater dimension of the slit and means (15) located on said interior walls of said recess laterally with respect to said slit for blocking the tongue in said position.

2. The sole assembly according to claim 1 wherein said recess has a top and is provided with a circular seat (13) in the portion corresponding to the said slit (4).

3. The sole assembly according to claim 1 wherein two cut-out portions (16) in diametrically opposite positions are formed in said threaded bushing.

4. The sole assembly according to claim 1 wherein said tongue is blocked in a position transversal with respect to the greater dimension of the slit by segments (15) formed on the lateral walls of said recess arranged substantially transversally with respect to the first greater dimension of the slit.

5. The sole assembly according to claim 1 wherein said tongue is manufactured separately from said sole.

6. A sole assembly for sports shoes comprising at least one accessory element (9) releasably mountable on said sole, said accessory element having a threaded portion (8), said sole having at least one recess (2) formed in said sole in the area where said accessory element is to be mounted, said recess extending within the thickness of said sole and communicating towards the exterior by means of a slit (4), said slit having a first dimension greater than a second dimension, a tongue (6) insertable in said slit, said tongue having a first dimension greater than a second dimension, said recess having interior walls (5) corresponding to the first greater dimension of the slit in the shape of circular segments, the first greater dimension of said tongue being equal to the diameter of said circular segments, said tongue having an internal threaded bushing (7), said threaded portion of said accessory element engaging with said threaded bushing when said tongue is inserted in said slit and when said tongue is rotated to be in a position transverseal with respect to the first greater dimension of the slit, means (10) located on said interior walls of said recess laterally with respect to said slit for blocking the tongue in said position, and wherein two cut-out portions (16) in diametrically opposite positions are formed in said threaded bushing.

7. The sole assembly according to claim 6 wherein said means for blocking the tongue in the position transversal with respect to the greater dimensions of the slit consists of protuberances or ribs within the said recess positioned laterally with respect to said slit (4).

* * * * *